US009228152B2

(12) United States Patent
Thompson et al.

(10) Patent No.: US 9,228,152 B2
(45) Date of Patent: Jan. 5, 2016

(54) FRICTION REDUCING ADDITIVE

(75) Inventors: Lee Thompson, Trimdon Grange (GB); Steven James Randles, Guisborough (GB); Stephen Boyde, Cleveland (GB); John Gamwell, Goole (GB); Nicola Readman, York (GB)

(73) Assignee: CRODA INTERNATIONAL PLC, Goole, East Yorkshire (GB)

( * ) Notice: Subject to any disclaimer, the term of this patent is extended or adjusted under 35 U.S.C. 154(b) by 468 days.

(21) Appl. No.: 13/582,589

(22) PCT Filed: Mar. 3, 2011

(86) PCT No.: PCT/GB2011/000287

§ 371 (c)(1),
(2), (4) Date: Oct. 16, 2012

(87) PCT Pub. No.: WO2011/107739

PCT Pub. Date: Sep. 9, 2011

(65) Prior Publication Data

US 2013/0035270 A1 Feb. 7, 2013

(30) Foreign Application Priority Data

Mar. 4, 2011 (GB) ..... 1003579.8

(51) Int. Cl.

| | |
|---|---|
| ***C10M 145/26*** | (2006.01) |
| ***C10M 145/22*** | (2006.01) |
| ***C10M 149/18*** | (2006.01) |
| ***C10M 145/28*** | (2006.01) |
| *C10L 1/198* | (2006.01) |
| *C10L 1/238* | (2006.01) |
| *C10L 10/08* | (2006.01) |

(52) U.S. Cl.

CPC ..... *C10M 145/26* (2013.01); *C10M 145/22* (2013.01); *C10M 145/28* (2013.01); *C10M 149/18* (2013.01); *C10L 1/1983* (2013.01); *C10L 1/1985* (2013.01); *C10L 1/2381* (2013.01); *C10L 10/08* (2013.01); *C10M 2209/102* (2013.01); *C10M 2209/103* (2013.01); *C10M 2209/104* (2013.01); *C10M 2217/044* (2013.01); *C10N 2230/06* (2013.01); *C10N 2240/10* (2013.01)

(58) Field of Classification Search

CPC ..... C10M 145/26; C10M 145/22; C10M 145/28; C10M 149/18; C10M 2209/102; C10M 2209/103; C10M 2209/104; C10M 2217/044; C10N 2230/06; C10N 2240/10; C10L 1/1983; C10L 1/1985; C10L 1/2381

USPC ..... 508/304, 110

See application file for complete search history.

(56) References Cited

U.S. PATENT DOCUMENTS

| | | | | |
|---|---|---|---|---|
| 3,954,915 | A | 5/1976 | Schwab et al. | |
| 5,688,748 | A * | 11/1997 | Tomizawa | 508/363 |
| 6,458,750 | B1 | 10/2002 | Dardin et al. | |
| 6,533,830 | B1 | 3/2003 | Oppenlander et al. | |
| 2004/0154216 | A1 * | 8/2004 | Huffer et al. | 44/385 |
| 2006/0189490 | A1 * | 8/2006 | Dardin et al. | 508/469 |
| 2006/0247386 | A1 | 11/2006 | Ruhe et al. | |

FOREIGN PATENT DOCUMENTS

| | | |
|---|---|---|
| EP | 0024848 | 3/1981 |
| GB | 2117398 | 10/1983 |
| WO | WO 03/080772 | 10/2003 |
| WO | WO 2008/075947 | 6/2008 |
| WO | WO 2008075947 A1 * | 6/2008 |

OTHER PUBLICATIONS

Official Action in corresponding Japanese Patent Application No. 2012-555483, dated Jun. 3, 2014 (English Translation).

International Search Report dated May 12, 2011 for PCT/GB2011/000287.

* cited by examiner

*Primary Examiner* — James Goloboy

(74) *Attorney, Agent, or Firm* — Jones Day

(57) ABSTRACT

An automotive engine oil and/or fuel comprising a base stock and an organic polymeric friction reducing additive is claimed. A method of reducing friction in an automotive engine oil and/or fuel by the addition of the organic polymeric friction reducing additive to the base stock is also claimed.

20 Claims, No Drawings

FRICTION REDUCING ADDITIVE

CROSS REFERENCE TO RELATED APPLICATION

This application is the National Phase application of International Application No. PCT/GB2011/000287, filed Mar. 3, 2011, which designates the United States and was published in English. The foregoing related application, in its entirety, is incorporated herein by reference.

This invention relates to a non-aqueous lubricating oil formulation comprising an organic polymeric friction reducing additive for an oil system. The invention relates, in particular, to an automotive engine oil and/or fuel comprising a base stock and an organic polymeric friction reducing additive. It further relates to a method of reducing friction in an automotive engine oil and/or fuel by the addition of the organic polymeric friction reducing additive to the base stock.

Automotive engine oils typically comprise a lubricant base stock and an additive package, both of which can contribute significantly to the properties and performance of the automotive engine oil.

To create a suitable engine oil, additives are blended into the chosen base stock. The additives either enhance the stability of the lubricant base stock or provide additional protection to the engine. Examples of engine oil additives include antioxidants, antiwear agents, detergents, dispersants, viscosity index improvers, defoamers and pour point depressants, friction reducing additives.

One area of concern for automotive engines is around reduction of fuel consumption and energy efficiency. It is well known that the automotive engine oil has a significant part to play in the overall energy consumption of automotive engines. Automotive engines can be thought of as consisting of three discreet but connected mechanical assemblies which together make up the engine, the valve train, the piston assembly, and the bearings. Energy losses in mechanical components can be analysed according to the nature of the friction regime after the well known Stribeck curve. Predominant losses in the valve train are boundary and elastohydrodynamic, in the bearings are hydrodynamic, and the pistons hydrodynamic and boundary. Hydrodynamic losses have been gradually improved by the reduction of automotive engine oil viscosity. Elastohydrodynamic losses can be improved by careful selection of the base stock type, taking into account the traction coefficient of the base stock. Boundary losses can be improved by careful selection of friction reducing additive. Careful selection of both base stock and friction reducing additive is therefore important, but it is not as simple as choosing the best base stock for hydrodynamic and elastohydrodynamic properties, and then choosing a friction reducing additive which is known to be active in the boundary regime. The interaction of base stock, friction reducing additive and other additives needs to be considered.

Friction reducing additives that have been used to improve fuel economy fall into three main chemically-defined categories, which are organic, metal organic and oil insoluble. The organic friction reducing additives themselves fall within four main categories which are carboxylic acids or their derivatives, which includes partial esters, nitrogen-containing compounds such as amides, imides, amines and their derivatives, phosphoric or phosphonic acid derivatives and organic polymers. In current commercial practice examples of friction reducing additives are glycerol monooleate and oleylamide, which are both derived from unsaturated fatty acids.

Whilst initial fuel economy requirements, for which the above friction reducing additives were designed, were focused on the fresh engine oil only (as defined in the ILSAC GF-3 specification), engine oil specifications have now been developed that include fuel economy longevity requirements as well (GF-4). The current range of commercial engine friction reducing additives, as mentioned above, was not designed to meet the above mentioned combination of fuel economy and fuel economy longevity requirements for friction reducing additives. For example it is known that both glycerol monooleate and oleylamide are susceptible to oxidative breakdown over time. Furthermore, there is another disadvantage in the use of oleylamide as it has low compatibility with the formulated base oils currently being used.

For the GF-4 specification, Sequence VI-B fuel efficiency engine testing includes ageing stages of 16 and 80 hours in order to determine fuel economy longevity as well as fuel economy, which was part of the previous GF-3 specification. These ageing stages are equivalent to 4000-6000 miles of mileage accumulation required prior to the EPA Metro/Highway Fuel economy test. That test is used in determining the Corporate Average Fuel Economy (CAFE) regulation parameter for a vehicle. Currently the GF-5 specification is being developed with the aim of being adopted in 2010. This specification provides a new Sequence VI-D engine fuel efficiency testing programme which will have even more stringent requirements for both fuel economy and fuel economy longevity. It is to be noted that in GF-5 the terms fuel economy and fuel economy longevity are to be replaced by resource conservation. The Sequence VI-D fuel economy test has been specifically developed to focus on the effectiveness of the friction reducing additive in the engine oil which it was felt was not fully considered by the VI-B test of GF-4. As the requirements for fuel economy and fuel economy efficiency become more stringent then it is expected that higher dose levels of friction modifier will be required in the engine oil to achieve the desired friction reduction.

Therefore the friction reducing agent needs to be designed, not only to be effective to meet the GF-5 fuel economy and fuel economy longevity requirements, but also such that it is stable in engine oil and fuel oil formulations at high dose levels. In GF-5 there will also be a test for such stability which is the emulsion stability test for oil mixed with 10% distilled water and 10% E85 (85% ethanol, 15% gasoline). Addition of glycerol monooleate as a friction modifier at high dose levels (at least 1.5% w/w) is known to lead to emulsion separation in engine oil and fuel oil formulations.

Fuel economy can also be improved by addition of friction reducing additives to the fuel itself. It is believed that the fuel delivers the friction reducing additives to the piston ring-cylinder wall interface where friction is known to be high and the oil quantity is deliberately kept low. Furthermore it has been found that as the friction-reducing additive in the fuel accumulates in the engine oil then friction is also reduced in oil-lubricated parts. The presence of additives in diesel fuel has been disclosed to address fuel lubricity issues caused by reduction of sulphur compounds and hydrotreating of fuels, in combination with increasing injection pressures in fuel systems in modern engine designs.

Reduction of boundary friction is also a desirable performance characteristic for other non-aqueous lubricating oil applications including automotive gear and transmission oils, industrial gear oils, hydraulic oils, compressor oils, turbine oils, cutting oils, rolling oils, drilling oils, lubricating greases and the like.

We have now surprisingly discovered a range of organic polymeric materials that can provide improved fuel economy and fuel economy longevity as compared to the current commercial friction reducing additives in engine oils and fuels. Furthermore these organic polymeric materials exhibit superior oxidative stability as compared to the current commercial friction reducing additives. The organic polymeric materials of the invention have also been found to provide good film thickness coverage at low speeds and they are stable in formulations at high dose rates.

The present invention provides an organic polymeric friction reducing additive for a non-aqueous lubricating oil, the additive having a molecular weight ranging from 1000 to 30,000 Daltons and being the reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides;
c) optionally at least one backbone moiety capable of linking together polymeric sub units; and
d) optionally a chain terminating group.

The organic polymeric friction reducing additive is preferably usable as a friction reducing additive in automotive engine oils and fuels, automotive gear and transmission oils, industrial gear oils, hydraulic oils, compressor oils, turbine oils, cutting oils, rolling oils, drilling oils, lubricating greases and the like.

There is also provided the use of non-aqueous oil formulations comprising the organic polymeric friction reducing additive of the first aspect of the invention as lubricating oils or functional fluids.

The invention accordingly further provides a non-aqueous lubricating oil comprising a base stock and an organic polymeric friction reducing additive wherein the additive has a molecular weight ranging from 1000 to 30,000 Daltons and is the reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides;
c) optionally at least one backbone moiety capable of linking together polymeric sub units; and
d) optionally a chain terminating group.

Preferably, the non-aqueous lubricating oil is an automotive engine oil and/or fuel.

The hydrophobic polymeric sub unit preferably comprises a hydrophobic polymer which is a polyolefin or a polyalphaolefin, more preferably a polyolefin.

The polyolefin is preferably derived from a polymer of a monoolefin having from 2 to 6 carbon atoms such as ethylene, propylene, butane and isobutene, more preferably isobutene, the said polymer containing a chain of from 15 to 500, preferably 50 to 200 carbon atoms.

The hydrophilic polymeric sub unit comprises a hydrophilic polymer selected from a polyether, a polyamide or a polyester. Examples of polyester include polyethylene terephthalate, polylactide and polycaprolactone. Examples of polyether include polyglycerol and polyalkylene glycol. In a particularly preferred embodiment the hydrophilic polymeric sub unit comprises a hydrophilic polymer which is a polymer of a water soluble alkylene glycol. A preferred hydrophilic polymeric sub unit comprises a hydrophilic polymer which is polyethylene glycol (PEG), preferably PEG having a molecular weight of 300 to 5,000 Da, more preferably 400 to 1000 Da, especially 400 to 800 Da. Alternatively, a mixed poly (ethylene-propylene glycol) or mixed poly(ethylene-butylene glycol) may be used provided they achieve the desired water solubility criteria. Exemplary hydrophilic polymer sub units for use in the present invention may comprise $PEG_{400}$, $PEG_{600}$ and $PEG_{1000}$.

Other suitable hydrophilic polymeric sub units may comprise hydrophilic polymers which are polyethers and polyamides derived from diols and diamines containing acidic groups, e.g. carboxylic acid groups, sulphonyl groups (e.g. sulphonyl styrenic groups), amine groups (e.g. tetraethylene pentamine (TEPA) or polyethylene imine (PEI)), or hydroxyl groups (e.g. sugar based mono- or co-polymers).

The hydrophilic polymeric sub unit may be either linear or branched.

During the course of the reaction some of the hydrophobic and hydrophilic polymeric sub units may link together to form block copolymer units. Either or both the hydrophobic and hydrophilic polymeric sub units may comprise functional groups which enable them to link with the other sub unit. For example the hydrophobic polymeric sub unit may be derivatised so that it has a diacid/anhydride grouping by reaction with an unsaturated diacid or anhydride, for example maleic anhydride. The diacid/anhydride can react by esterification with hydroxyl terminated hydrophilic polymeric sub units, for example a polyalkylene glycol. In a further example the hydrophobic polymeric sub unit may be derivatised by an epoxidation reaction with a peracid, for example perbenzoic or peracetic acid. The epoxide can then react with hydroxyl and/or acid terminated hydrophilic polymeric sub units. In a further example a hydrophilic polymeric sub unit which has a hydroxyl group may be derivatised by esterification with unsaturated mono carboxylic acids, for example vinyl acids, specifically acrylic or methacrylic acid. This derivatised hydrophilic polymeric sub unit can then react with a polyolefin hydrophobic polymeric sub unit by free radical copolymerisation.

A particularly preferred hydrophobic polymeric sub unit comprises polyisobutylene polymer which has been subjected to maleinisation to form polyisobutylene succinic anhydride (PIBSA) having a molecular weight in the range of 300 to 5000 Da, preferably 500 to 1500 Da, especially 800 to 1200 Da. Polyisobutylene succinic anhydrides are commercially available compounds made by an addition reaction between poly(isobutene) having a terminal unsaturated group and maleic anhydride.

Such block copolymer units, if present, may be directly linked to each other and/or they may be linked together by the at least one backbone moiety. Preferably they are linked together by the at least one backbone moiety. The choice of backbone moiety capable of linking together the block copolymer units is governed by whether the linking of units is between two hydrophobic polymeric sub units, between two hydrophilic polymeric sub units or between a hydrophobic polymeric sub unit and a hydrophobic polymeric sub unit. Generally polyols and polycarboxylic acids form suitable backbone moieties. The polyol may be a diol, triol, tetrol and/or related dimers or trimers or chain extended polymers of such compounds. Examples of suitable polyols include glycerol, neopentyl glycol, trimethylolethane, trimethylolpropane, trimethylolbutane, pentaerthyritol, dipentaerthyritol, tripentaerthyritol and sorbitol. In a preferred embodiment the polyol is glycerol. Suitably the at least one backbone moiety is derived from a polycarboxylic acid, for example a di- or tricarboxylic acid. Dicarboxylic acids are preferred polycarboxylic acid backbone moieties for linking units, particularly straight chained dicarboxylic acids, though branched chain dicarboxylic acids may also be suitable. Particularly suitable are straight chained dicarboxylic acids having a chain length of between 2 and 10 carbon atoms, for example oxalic, malonic, succinic, glutaric, adipic, pimelic, suberic, azelaic or sebacic acid. Unsaturated dicarboxylic acids such as maleic acid may also be suitable. A particularly preferred polycarboxylic acid backbone moiety to link units is adipic acid. Alternative linking backbone moieties are low molecular weight alkenyl succinic anhydrides (ASA), such as $C_{18}$ ASA.

In any of the organic polymeric friction reducing additives different or same backbone moieties can be used to link together such block copolymer units. When present the number of block copolymer units in the organic polymeric friction reducing additive typically ranges from 1 to 20 units, preferably 1 to 15, more preferably 1 to 10 and especially 1 to 7 units.

When the product of the reaction ends in a reactive group (e.g. as with the OH in PEG), it may be desirable or useful in some circumstances to introduce a chain terminating group to the end of the product of the reaction. It is, for example, particularly simple to attach a carboxylic acid to an exposed hydroxyl group on PEG via an ester linkage. In this respect any fatty carboxylic acid would be suitable. Suitable fatty acids include C12-22 linear saturated, branched saturated, linear unsaturated and branched unsaturated acids, including, but not limited to lauric acid, erucic acid, isostearic acid, palmitic acid, oleic acid and linoleic acid, preferably palmitic acid, oleic acid and linoleic acid. A particularly preferred fatty acid for combination with the surfactant is tall oil fatty acid (TOFA), a derivative of tall oil, which is primarily oleic acid.

The organic polymeric friction reducing additive of the invention has a molecular weight of from 1000 to 30000 Da, preferably from 1500 to 25000, more preferably from 2000 to 20000 Da. Generally a composition comprising the organic polymeric friction reducing additive will comprise a range of polymer chains of different lengths such that there will be a range of molecular masses in a particular composition. In such a case it is desirable that a substantial portion of the organic polymeric friction reducing additive molecules are within the above mentioned size ranges.

The organic polymeric friction reducing additive of the invention has a desired acid value of less than 20, preferably less than 15.

In one preferred embodiment of the invention the organic polymeric friction reducing additive is the reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides; and
c) a chain terminating group.

For such an embodiment the preferred molecular weight range is 1000 to 3000 Da and the desired acid value is less than 15.

In a separate preferred embodiment of the invention the organic polymeric friction reducing additive is the reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides; and
c) at least one backbone moiety capable of linking together polymeric sub units For such an embodiment the preferred molecular weight range is 3000 to 25000, more preferably 5000 to 20000 Da. The desired acid value is preferably less than 10, more preferably less than 7.

In a separate preferred embodiment of the invention the organic polymeric friction reducing additive is the reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides;
c) at least one backbone moiety capable of linking together polymeric sub units; and
d) a chain terminating group.

For such an embodiment the preferred molecular weight range is 2000 to 10000, more preferably 2000 to 5000 Da. The desired acid value is preferably less than 15, more preferably less than 10.

The ingredients of the reaction a), b), c) when present and d) when present may be mixed in a single step process or they may be mixed together in a multi-step process.

For an automotive engine oil the term base stock includes both gasoline and diesel (including heavy duty diesel (HDDEO) engine oils. The base stock may be chosen from any of the Group I to Group VI base oils (which includes Group $III^+$ gas to liquid) as defined by the American Petroleum Institute (API) or a mixture thereof. Preferably the base stock has one of Gp II, Gp III or a Gp IV base oil as its major component, especially Gp III. By major component it is meant at least 50% by weight of base stock, preferably at least 65%, more preferably at least 75%, especially at least 85%. The base stock typically ranges from 0W to 15W. The viscosity index is preferably at least 90 and more preferably at least 105. The Noack volatility, measured according to ASTM D-5800, is preferably less than 20%, more preferably less than 15%.

The base stock may also comprise as a minor component, preferably less than 30%, more preferably less than 20%, especially less than 10% of any or a mixture of Group III+, IV and/or Group V base stocks which have not been used as the major component in the base stock. Examples of such Group V base stocks include alkyl naphthalenes, alkyl aromatics, vegetable oils, esters, for example monoesters, diesters and polyol esters, polycarbonates, silicone oils and polyalkylene glycols. More than one type of Group V base stock may be present. Preferred Group V base stocks are esters, particularly polyol esters.

For engine oils the organic polymeric friction reducing additive is present at levels of 0.2 to 5 wt %, preferably 0.3 to 3 wt %, more preferably 0.5 to 2% in the automotive engine oil.

The automotive engine oil also comprises other types of additives of known functionality at levels between 0.1 to 30%, more preferably between 0.5 to 20% more especially between 1 to 10% of the total weight of the engine oil. These can include detergents, dispersants, oxidation inhibitors, corrosion inhibitors, rust inhibitors, anti wear additives, foam depressants, pour point depressants, viscosity index improvers and mixtures thereof. Viscosity index improvers include polyisobubutenes, polymethacrylate acid esters, polyacrylate acid esters, diene polymers, polyalkyl styrenes, alkenyl aryl conjugated diene copolymers and polyolefins. Foam depressants include silicones and organic polymers. Pour point depressants include polymethacrylates, polyacrylates, polyacrylamides, condensation products of haloparaffin waxes and aromatic compounds, vinyl carboxylate polymers, terpolymers of dialkylfumarates, vinyl esters of fatty acids and alkyl vinyl ethers. Ashless detergents include carboxylic dispersants, amine dispersants, Mannich dispersants and polymeric dispersants. Antiwear additives include ZDDP, ashless and ash containing organic phosphorous and organo-sulphur compounds, boron compounds, and organo-molybdenum compounds. Ash-containing dispersants include neutral and basic alkaline earth metal salts of an acidic organic compound. Oxidation inhibitors include hindered phenols and alkyl diphenylamines. Additives may include more than one functionality in a single additive.

For fuel the term base stock includes both gasoline and diesel fuels.

For fuel the organic polymeric friction reducing additive is present at levels of 10 to 1000 ppm, preferably 50 to 250 ppm (w/w).

The fuel also comprises other types of additives of known functionality at levels typically present at a total level of between 10 to 1000 ppm, more preferably between 50 to 400 ppm of the total weight of the fuel. These can include cetane improvers, anti oxidants, metal deactivators, deposit modifiers, diesel stabilisers, anti stat agents, lubricity agents, deposit control agents, diesel flow agents, demulsifiers, diesel detergents, anti foams, wax anti-settling agents, dyes and anti valve seat recession additives.

In a further aspect of the invention a solvent is present with the organic polymeric friction reducing additive. The organic polymeric friction reducing additive of the invention can have a high viscosity. In such cases in order to make it easier to access once manufactured and transfer to end users then solvent may be present to reduce the viscosity and provide the organic polymeric friction reducing additive in a pourable form. Suitable solvents will be apparent to the person skilled in the art. Exemplary solvents include Gp III or Gp IV base oils present at levels of up to 50% by wt depending on the viscosity of the organic polymeric friction reducing additive.

In another aspect of the invention is a method of lubricating an automotive engine using an automotive engine oil comprising a base stock and a polymeric friction reducing additive wherein the additive has a molecular weight ranging from 1000 to 30,000 Daltons and comprises reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides;
c) optionally at least one backbone moiety capable of linking together polymeric sub units; and
d) optionally a chain terminating group.

In another aspect of the invention is a method of reducing friction in an automotive engine using an automotive engine oil comprising a base stock and a polymeric friction reducing additive wherein the additive has a molecular weight ranging from 1000 to 30,000 Daltons and comprises reaction product of a) a hydrophobic polymeric sub unit which comprises a hydrophobic polymer selected from polyolefins, polyacrylics and polystyrenyls
b) a hydrophilic polymeric sub unit which comprises a hydrophilic polymer selected from polyethers, polyesters, polyamides;
c) optionally at least one backbone moiety capable of linking together polymeric sub units; and
d) optionally a chain terminating group.

The organic polymeric friction reducing additives of the invention provide a number of advantages with respect to current commercial friction modifiers used in engine oils and fuels. For example they exhibit enhanced fuel economy and fuel economy longevity and enhanced oxidative stability.

The organic polymeric friction reducing additive of the invention preferably has a coefficient of friction measured using a mini traction machine at 150° C. of less than or equal to 0.05 at speeds of up to 0.05 m/s.

The organic polymeric friction reducing additives of the invention provide a thick film at low speeds. Fuel efficient engine oils tend to have a low viscosity to reduce viscous drag in the hydrodynamic regime but low viscosity engine oils typically have difficulty forming films at low speeds. Therefore the organic polymer friction reducing additives of the invention provide the advantage of thick film formation to reduce engine wear at low speeds alongside their enhanced fuel economy capabilities.

Addition of the organic friction reducing additive of the invention can be at high dose rates, up to 5 wt %, without comprising the emulsion stability of the engine oil or fuel.

The invention will now be described further by way of example only with reference to the following Examples.

EXAMPLES

Example 1

Organic Polymeric Friction Reducing Additive—Additive A

The hydrophobic polymeric sub unit is a commercially available maleinised polyisobutylene derived from a polyisobutylene of average molecular weight 1000 amu with an approximate degree of maleinisation of 78% and a saponification value of 85 mg KOH/g.

The hydrophilic polymeric sub unit is a commercially available poly (ethyleneoxide), $PEG_{600}$, having a hydroxyl value of 190 mg KOH/g.

Additive A

Maleinised polyisobutylene (113.7 g) and glycerol (5.5 g), were charged to a glass round bottomed flask equipped with mechanical stirrer, isomantle heater and overhead condenser and reacted at 100-130 deg C. under nitrogen atmosphere for 4 hrs. $PEG_{600}$ (71.8 g) and esterification catalyst tetrabutyl titanate (0.2 g) were added, and reaction continued at 200-220 deg C. with removal of water and reduced pressure to an acid value <6 mg KOH/g. Adipic acid (8.8 g) was added and reaction continued under the same conditions to acid value <5 mkg KOH/g. The final product polyester, Additive A, was a dark brown liquid with viscosity at 100 deg C. of approximately 3500 cP.

Organic Polymeric Friction Reducing Additive—Additive B

The hydrophobic polymeric sub unit is a commercially available maleinised polyisobutylene derived from a polyisobutylene of average molecular weight 950 amu with an approximate saponification value of 98 mg KOH/g.

The hydrophilic polymeric sub unit is a commercially available poly (ethyleneoxide), $PEG_{600}$, having a hydroxyl value of 190 mg KOH/g.

Additive B

Maleinised polyisobutylene, (110 g), $PEG_{600}$ (72 g), glycerol (5 g) and tall oil fatty acid (25 g) were charged to a glass round bottomed flask equipped with mechanical stirrer, isomantle heater and overhead condenser and reacted with esterification catalyst tetrabutyl titanate (0.1 g) at 200-220 deg C. with removal of water to final acid value <10 mg KOH/g. The final product polyester, Additive B, was a dark brown, viscous liquid.

Organic Polymeric Friction Reducing Additive—Additive C

The hydrophobic copolymer reactant is a commercially available maleinised polyisobutylene, derived from a polyisobutylene of average molecular weight 1000 amu, with an approximate saponification value 95 mg KOH/g.

The hydrophilic copolymer reactant was a commercially available poly(ethyleneoxide) ($PEG_{600}$) having a hydroxyl value of 190 mg KOH/g.

Additive C

Maleinised polyisobutylene, (100 g), polyethylene oxide (70 g) and tall oil fatty acid (25 g) were charged to a glass round bottomed flask equipped with mechanical stirrer, isomantle heater, overhead condenser and Dean and Stark separator and reacted with entraining solvent xylene (25 g) under reflux with water removal to final acid value <10 mg KOH/g. At end of reaction, residual xylene was stripped off under reduced pressure to give product polyester, Additive C, as a brown viscous liquid.

Example 2

The coefficient of friction of an automotive engine oil comprising 92% GpIV (INEOS Durasyn 166 PAO6) and 8% GpV base stock (Priolube 3970 ester ex Croda)) and further comprising 0.5% organic polymeric friction reducing additive was determined at 100° C. and 150° C. using a Mini Traction Machine with a ¾ inch ball on a smooth disc. The load applied was 36N (1 GPa contact pressure) and the speed of rotation was from 0.01 to 0.05 m/s. The results are illustrated in Table 1 for 100° C. and Table 2 for 150° C.

TABLE 1

| Polymeric friction reducing Additive Speed (m/s) | No Additive present Friction coeff | Additive A Friction coeff | Additive B Friction coeff | Glycerol Monooleate (GMO) (comparative) Friction coeff | Oleylamide (OLA) (comparative) Friction coeff |
|---|---|---|---|---|---|
| 0.01 | 0.088 | 0.043 | 0.033 | 0.070 | 0.063 |
| 0.02 | 0.080 | 0.039 | 0.032 | 0.060 | 0.065 |
| 0.05 | 0.078 | 0.037 | 0.036 | 0.048 | 0.065 |

TABLE 2

| Polymeric friction reducing Additive Speed (m/s) | No Additive present Friction coeff | Additive A Friction coeff | Additive B Friction coeff | Glycerol Monooleate (GMO) (comparative) Friction coeff | Oleylamide (OLA) (comparative) Friction coeff |
|---|---|---|---|---|---|
| 0.01 | 0.105 | 0.013 | 0.050 | 0.042 | 0.070 |
| 0.02 | 0.095 | 0.013 | 0.050 | 0.038 | 0.062 |
| 0.05 | 0.088 | 0.015 | 0.048 | 0.045 | 0.065 |

Example 3

Example 2 was repeated at both 100° C. and 150° C. except that the automotive engine oil was replaced by a formulated Gp II 5W-40 HDDEO (Shell Catenex T121 (13%), Catenex T129 (50%) and Catenex T145 (18%) with 6% Pantone 8002 and 13% friction modifier free additive package)

The results are illustrated in Table 3.

TABLE 3

| Polymeric friction reducing Additive | Not present | Additive A | Glycerol Monooleate (comparative) | Not present | Additive A | Glycerol Monooleate (comparative) |
|---|---|---|---|---|---|---|
| Temp (° C.) | 100 | 100 | 100 | 150 | 150 | 150 |
| Speed (m/s) | Friction coeff | Friction coeff | Friction coeff | Friction coeff | Friction coeff | Friction coeff |
| 0.01 | 0.125 | 0.074 | 0.095 | 0.135 | 0.110 | 0.121 |
| 0.02 | 0.114 | 0.068 | 0.087 | 0.134 | 0.114 | 0.121 |
| 0.05 | 0.057 | 0.042 | 0.042 | 0.109 | 0.089 | 0.087 |

Example 4

Example 2 was repeated at both 100° C. and 150° C. except that the automotive engine oil was replaced by a Gp II mineral oil (Shell Catenex T129) The results are illustrated in Table 4.

TABLE 4

| Polymeric friction reducing Additive | Not present | Additive A | Glycerol Monooleate (comparative) | Not present | Additive A | Glycerol Monooleate (comparative) |
|---|---|---|---|---|---|---|
| Temp (° C.) | 100 | 100 | 100 | 150 | 150 | 150 |
| Speed (m/s) | Friction coeff | Friction coeff | Friction coeff | Friction coeff | Friction coeff | Friction coeff |
| 0.01 | 0.102 | 0.052 | 0.09 | 0.091 | 0.023 | 0.090 |
| 0.02 | 0.092 | 0.05 | 0.08 | 0.085 | 0.021 | 0.078 |
| 0.05 | 0.084 | 0.052 | 0.069 | 0.077 | 0.022 | 0.076 |

It is clear from the data in Examples 2, 3 and 4 that polymeric friction reducing additives of the present invention are effective friction modifiers for automotive engine oils and are superior to current commercially available products.

Example 5

Film thickness was measured, using the principle of optical interferometry on a PCS instruments ultra film thin film rig with a silica coated glass disc positioned above a loaded ball for 0.5% by weight of the polymeric friction reducing additive of the invention, Additive A, in the automotive engine oil of Example 2. The film thickness in nm was measured at a temperature of 60° C. with a load pressure of 20N at a speed of 0.004 m/s to 5 m/s. The results are recorded in Table 5.

TABLE 5

| Speed (m/s) | Film thickness (nm) - no Additive | Speed (m/s) | Flim thickness (nm) - Additive A |
|---|---|---|---|
| 4.602 | 252.4 | 4.364 | 254.6 |
| 0.852 | 85.3 | 1.133 | 109.5 |
| 0.610 | 67.6 | 0.809 | 87.0 |
| 0.312 | 33.5 | 0.413 | 47.8 |
| 0.016 | 4.8 | 0.015 | 10.3 |
| 0.012 | 4.4 | 0.008 | 9.1 |
| 0.006 | 2.3 | 0.006 | 8.1 |
| 0.004 | 2.0 | 0.004 | 6.8 |

The above data illustrates the ability of an organic polymeric friction reducing additive of the invention to form a thick film at low speeds.

Example 6

The oxidative stability of organic polymeric friction reducing additive of the invention in was measured at 100° C. over 164 hours according to IP307. The initial acid value, acid value after oxidation and acid value of volatiles in distilled water after oxidation were measured and the change in acid value calculated. The results are shown in Table 6.

TABLE 6

| Additive | Initial Acid Value | Acid value after oxidation | Acid value of volatiles in distilled water | Total Acid Value after oxidation | Change in acid value due to oxidation process |
|---|---|---|---|---|---|
| Additive A | 3.3 | 1.3 | 4.6 | 5.9 | 2.6 |
| Additive B | 6.6 | 3.5 | 5.4 | 8.9 | 2.3 |
| GMO (comparative) | 0.1 | 4.0 | 1.6 | 5.6 | 5.5 |

The results show that organic polymeric friction reducing additives of the invention have a far greater oxidative stability than current commercial products.

Example 7

Compatibility of 0.5% of organic polymeric friction reducing additive of the invention in both GpII (Catenex T129 ex Shell) and GpIV (Durasyn 166 ex INEOS) base stocks was measured at 23 and 4° C. The results are shown in Table 7.

TABLE 7

| Temp | Gp II base stock | | | Gp IV base stock | | |
|---|---|---|---|---|---|---|
| in ° C. | Additive A | GMO (comparative) | OLA (comp.) | Additive A | GMO (comp.) | OLA (comp.) |
| 23 | Yes | Yes | No | Yes | Yes | No |
| 4 | Yes | No | No | Yes | No | No |

In both cases Additive A was found to be compatible with the base stocks at both temperatures which compares favourably with the current commercial products.

Example 8

Emulsion retention of 1% of the organic polymeric friction reducing additive of the invention was measured in a Gp II (Catenex T129) and Gp III (Shell XHVI 5.2) mineral oil according to the proposed GF-5 emulsion retention test. In each case 185 ml of mineral oil with additive, 18.5 ml of E85 and 18.5 ml of distilled water were blended using a Waring blender for 1 minute at room temperature. Each blend was then stored at both room temperature and 0° C. for 24 hours and the separation assessed. The results are recorded in Tables 8 and 9 below for room temperature and 0° C. respectively.

TABLE 8

| Additive | Mineral Oil | Oil (%) | Emulsion (%) | Water (%) | Pass/Fail |
|---|---|---|---|---|---|
| None | Catenex 129 | | | | |
| Additive A | Catenex 129 | 0 | 100 | 0 | Pass |
| GMO (comparative) | Catenex 129 | 1 | 85 | 14 | Fail |
| None | Shell XHVI 5.2 | | | | |
| Additive A | Shell XHVI 5.2 | 0 | 100 | 0 | Pass |
| GMO (comparative) | Shell XHVI 5.2 | 1 | 85 | 14 | Fail |

TABLE 9

| Additive | Mineral Oil | Oil (%) | Emulsion (%) | Water (%) | Pass/Fail |
|---|---|---|---|---|---|
| None | Catenex 129 | | | | |
| Additive A | Catenex 129 | 0 | 100 | 0 | Pass |
| GMO (comparative) | Catenex 129 | 1 | 86 | 13 | Fail |
| None | Shell XHVI 5.2 | | | | |
| Additive A | Shell XHVI 5.2 | 0 | 100 | 0 | Pass |
| GMO (comparative) | Shell XHVI 5.2 | 1 | 85 | 14 | Fail |

The results in Tables 8 and 9 show that the organic polymeric friction modifier is stable at high dose levels of 1% compared to current commercial products.

Example 9

Organic Polymeric Friction Reducing Additive—Additive D

The hydrophobic polymeric sub unit is a maleinised polyisobutylene having approximate molecular weight 550 amu.

The hydrophilic polymeric sub unit is a commercially available poly (ethyleneoxide), $PEG_{600}$, having a hydroxyl value of 190 mg KOH/g.

Additive D

Maleinised polyisobutylene, (277 g), $PEG_{600}$ (606 g), adipic acid (59 g) and tall oil fatty acid (61 g) were charged to a glass round bottomed flask equipped with mechanical stirrer, isomantle heater and overhead condenser and reacted with esterification catalyst tetrabutyl titanate (0.1 g) at 200-220 deg C. with removal of water to final acid value <10 mg KOH/g. The final product polyester, Additive D, was a dark brown, viscous liquid.

Organic Polymeric Friction Reducing Additive—Additive E

The hydrophobic polymeric sub unit is a maleinised polyisobutylene having approximate molecular weight 1000 amu.

The hydrophilic polymeric sub unit is a commercially available poly (ethyleneoxide), $PEG_{1000}$ having a hydroxyl value of 110 mg KOH/g.

Additive E

Maleinised polyisobutylene, (438 g), $PEG_{1000}$ (445 g), glycerol (20 g) and tall oil fatty acid (97 g) were charged to a glass round bottomed flask equipped with mechanical stirrer, isomantle heater and overhead condenser and reacted with esterification catalyst tetrabutyl titanate (0.1 g) at 200-220 deg C. with removal of water to final acid value <10 mg KOH/g. The final product polyester, Additive E, was a dark brown, viscous liquid.

Example 10

The coefficient of friction of an automotive engine oil comprising 92% GpIV (INEOS Durasyn 166 PAO6) and 8% GpV base stock (Priolube 3970 ester ex Croda)) and further comprising 0.5% organic polymeric friction reducing additive was determined at 100° C. and 150° C. using a Mini Traction Machine with a ¾ inch ball on a smooth disc. The load applied was 36N (1 GPa contact pressure) and the speed of rotation was from 0.01 to 0.05 m/s. The results are illustrated in Table 10 for 100° C. and Table 11 for 150° C.

TABLE 10

| Polymeric friction reducing Additive Speed (m/s) | Not present Friction coeff | Additive D Friction coeff | Additive E Friction coeff | Glycerol Monooleate (GMO) (comparative) Friction coeff | Oleylamide (OLA) (comparative) Friction coeff |
|---|---|---|---|---|---|
| 0.01 | 0.088 | 0.010 | 0.032 | 0.070 | 0.063 |
| 0.02 | 0.077 | 0.012 | 0.029 | 0.059 | 0.065 |
| 0.05 | 0.071 | 0.024 | 0.036 | 0.048 | 0.063 |

TABLE 11

| Polymeric friction reducing Additive Speed (m/s) | Not present Friction coeff | Additive D Friction coeff | Additive E Friction coeff | Glycerol Monooleate (GMO) (comparative) Friction coeff | Oleylamide (OLA) (comparative) Friction coeff |
|---|---|---|---|---|---|
| 0.01 | 0.097 | 0.009 | 0.010 | 0.043 | 0.069 |
| 0.02 | 0.089 | 0.011 | 0.014 | 0.036 | 0.063 |
| 0.05 | 0.080 | 0.017 | 0.023 | 0.045 | 0.063 |

The invention claimed is:

1. A method of lubricating an automotive engine using an automotive engine oil formulation comprising a base stock and a polymeric friction reducing additive wherein the additive has a molecular weight ranging from 1000 to 30,000 Daltons and comprises the reaction product of:

a) a hydrophobic polymeric sub unit which comprises a polyolefin derivatized to comprise a diacid and/or anhydride group;

b) a hydrophilic polymeric sub unit which comprises a hydrophilic polymer selected from polyethers; and c) at least one of the following:

i) at least one backbone moiety capable of linking together polymeric sub units; or ii) a chain terminating group.

2. The method of lubricating of claim 1, wherein the hydrophobic polymeric sub unit comprises polyisobutylene polymer which has been subjected to maleinisation to form polyisobutylene succinic anhydride having a molecular weight in the range of 300 to 5000 Da.

3. The method of lubricating of claim 1, wherein the hydrophilic polymeric sub unit comprises a polyethylene glycol.

4. The method of lubricating of claim 1, wherein the backbone moiety is chosen from a polyol, a polycarboxylic acid and mixtures thereof.

5. The method of lubricating of claim 1, wherein the chain terminating group is any fatty carboxylic acid.

6. The method of lubricating of claim 1, wherein the reaction product comprises some block copolymer units formed from linking together during the reaction of some of the hydrophobic and hydrophilic polymeric sub units.

7. The method of lubricating of claim 6, wherein the number of block copolymer units ranges from 1 to 20.

8. The method of lubricating of claim 1, wherein the base stock has one of a Group II, Group III or Group IV base oil as its major component.

9. The method of lubricating of claim 1, wherein the method A reduces friction in the automotive engine.

10. The method of lubricating of claim 6, wherein the number of block copolymer units ranges from 1 to 15.

11. The method of lubricating of claim 6, wherein the number of block copolymer units ranges from 1 to 7.

12. The method of lubricating of claim 9, wherein the hydrophobic polymeric sub unit comprises polyisobutylene polymer which has been subjected to maleinisation to form polyisobutylene succinic anhydride having a molecular weight in the range of 300 to 5000 Da.

13. The method of lubricating of claim 9, wherein the hydrophilic polymeric sub unit comprises a polyethylene glycol.

14. The method of lubricating of claim 9, wherein the backbone moiety is chosen from a polyol, a polycarboxylic acid and mixtures thereof.

15. The method of lubricating of claim 9, wherein the chain terminating group is any fatty carboxylic acid.

16. The method of lubricating of claim 9, wherein the reaction product comprises some block copolymer units formed from linking together during the reaction of some of the hydrophobic and hydrophilic polymeric sub units.

17. The method of lubricating of claim 16, wherein the number of block copolymer units ranges from 1 to 20.

18. The method of lubricating of claim 16, wherein the number of block copolymer units ranges from 1 to 15.

19. The method of lubricating of claim 16, wherein the number of block copolymer units ranges from 1 to 7.

20. The method of lubricating of claim 9, wherein the base stock has one of a Group II, Group III or Group IV base oil as its major component.

* * * * *